US007325429B2

(12) United States Patent
Nakaike et al.

(10) Patent No.: US 7,325,429 B2
(45) Date of Patent: Feb. 5, 2008

(54) METHOD FOR MANUFACTURING SEAMLESS STEEL PIPE OR TUBE

(75) Inventors: Kouji Nakaike, Wakayama (JP); Tetsuya Nakanishi, Wakayama (JP); Junji Nakata, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/603,205

(22) Filed: Nov. 22, 2006

(65) Prior Publication Data

US 2007/0062238 A1 Mar. 22, 2007

Related U.S. Application Data

(63) Continuation of application No. PCT/JP2005/009622, filed on May 26, 2005.

(30) Foreign Application Priority Data

May 28, 2004 (JP) ..... 2004-159600
Mar. 30, 2005 (JP) ..... 2005-098897

(51) Int. Cl.
*B21B 19/04* (2006.01)

(52) U.S. Cl. ..... 72/97; 72/700

(58) Field of Classification Search ..... 72/97, 72/700; 148/506, 542, 592, 609
See application file for complete search history.

(56) References Cited

U.S. PATENT DOCUMENTS 6,988,387 B2 * 1/2006 Nakaike et al. ..... 72/97
7,100,410 B2 * 9/2006 Yamakawa et al. ..... 72/97

FOREIGN PATENT DOCUMENTS

| | | | |
|---|---|---|---|
| JP | 56-84107 | * | 7/1981 |
| JP | 59-208055 | | 11/1984 |
| JP | 63-281705 | | 11/1988 |
| JP | 4-182008 | * | 6/1992 |
| JP | 04-224659 | | 8/1992 |
| JP | 05-069011 | | 3/1993 |
| JP | 6-218406 | * | 8/1994 |
| JP | 10-005820 | | 1/1998 |
| JP | 2002-361304 | | 12/2002 |
| JP | 2003-001305 | | 1/2003 |
| JP | 2003-003212 | | 1/2003 |
| JP | 2004-043935 | | 2/2004 |

* cited by examiner

*Primary Examiner*—Ed Tolan
(74) *Attorney, Agent, or Firm*—Clark & Brody

(57) ABSTRACT

A round billet containing, by mass %, 10.50 to 14.00% of Cr with a value represented by the equation of "Cr+4Si−(22C+0.5Mn+1.5Ni+30N)" of not more than 9.0%, wherein the symbols of the elements represent the contents, by mass %, of the elements in the steel, is heated at a soaking temperature of 1100 to 1250 ° C. so that an in-furnace time (min) is not less than "0.5×Diameter of the round billet (mm)", and then pierced and rolled with a piercing efficiency by a piercing mill of not less than 50%, a value regulated by the equation: "{(Diameter of the round billet−Roll gap at the foremost end of the plug)/Diameter of the round billet}×100" of not more than 8.0, and a plug shape represented by the equation: "Radius of foremost end of the plug (mm)/Diameter of the round billet (mm)" of 0.06 to 0.17. The thus-manufactured high-Cr seamless steel pipe or tube has excellent internal surface properties with minimized internal surface defects.

4 Claims, No Drawings

METHOD FOR MANUFACTURING SEAMLESS STEEL PIPE OR TUBE

TECHNICAL FIELD

This application is a continuation of the international application PCT/JP2005/009622 filed on May 26, 2005, the entire content of which is herein incorporated by reference.

The application discloses the technology related to a method for manufacturing a seamless steel pipe or tube. Specifically, the application discloses the technology related to a method for manufacturing a high-Cr seamless steel pipe or tube containing, by mass %, 10.50 to 14.00% of Cr, which minimizes internal surface flaws, and is capable of efficiently manufacturing the seamless steel pipe or tube.

BACKGROUND ART

High-Cr seamless steel pipes or tubes containing, by mass %, 10.50 to 14.00% of Cr have been increasingly used for oil and gas wells, for various plants and for building structures.

By the way, a piercing and rolling method using an inclined roll type piercing mill (hereinafter often referred to as "piercing mill") is frequently applied to the recent piercing and rolling for high Cr-seamless steel pipes or tubes. Concretely, a hollow pipe or tube stock is manufactured from a solid steel stock with a round section (hereinafter referred to as "round billet" or simply as "billet") by use of a piercing mill. Then, the pipe or tube stock is rolled by an elongator such as a mandrel mill, a plug mill, an Assel mill, or a push bench to reduce the wall thickness thereof, and the outer diameter thereof is then narrowed by use of a constant diameter mill such as a stretch reducing mill or a sizing mill.

However, since the hot workability of high-Cr steel is lower than that of a so-called "common steel", the piercing and rolling by a piercing mill thereof tends to cause defects on the internal surface of the resulting pipe or tube stock. Typical examples of the defects on the internal surface of the pipe or tube stock include a so-called "internal fracture flaw", which may be called often "internal scab" or "lapping mark".

The internal surface defects of steel pipes or tubes may be roughly distinguished between defects resulting from internal surface defects and/or hot workability of the billet itself, that is to say, "material-originated flaw", and defects resulting from surface defects of an internal surface tool such as a piercing plug or bar used for pipe or tube making and/or pipe or tube making conditions or the like, that is to say, "machine-originated flaw". According to this view of classification, it is realized that the former "material-originated flaw" occurs mainly in the piercing and rolling stage, and the major flaw thereof is an internal fracture flaw.

The elimination of internal surface defects on steel pipes or tubes needs a lot of man-hours for treatments of resulting steel pipes or tubes in a different process, for removals of flawed portions from resulting steel pipes or tubes by cutting, or the like. Consequently, it leads to a remarkable reduction in production efficiency. Further, a deep flaw leads to disposal of the steel pipe or tube itself, resulting in deterioration of yield.

Therefore, the following techniques in the Patent Documents 1 to 6 are proposed for suppress internal surface defects on pipe or tube stock in the piercing and rolling stage which are directly linked to the internal surface defects on resulting steel pipes or tubes.

The Patent Document 1 discloses a technique for enhancing the hot workability of a steel stock in the piercing and rolling by a piercing mill while minimizing the contents of P and S that are impurity elements in a steel, thereby suppressing internal fracture flaws.

The Patent Document 2 discloses a technique for suppressing the production of δ-ferrite by reducing the heating temperature of a billet, that is the steel stock, and also by suppressing the temperature rise involved by work heat generation through reducing the average strain rate in the piercing and rolling by a piercing mill, thereby preventing the occurrence of internal fracture flaws.

The Patent Document 3 discloses a method for manufacturing a martensitic seamless steel pipe or tube, capable of improving the microstructure in hot working by regulating the contents of the specified alloy components, controlling the annealing heating time, and further setting the piercing temperature lower than 1200° C.

The Patent Document 4 discloses a technique for performing piercing and rolling while adjusting, in the piercing and rolling by a piercing mill with disk roll-type guide shoes, the diameter of a steel stock, the distance from the starting position of gripping the steel stock with inclined rolls to the tip of a plug, the clearance between guide shoes at the position of the tip of a plug, the inclined roll gap and the clearance between the guide shoes at the wall thickness determining position.

The Patent Document 5 discloses a method for manufacturing a high-Cr seamless steel pipe or tube, capable of improving the microstructure in hot working by regulating the content of Cr, the contents of S and P as impurity elements, and the contents of elements to be added to the high-Cr steel, and then adjusting the soaking time of the casting bloom or the billet, the soaking time of the rolling stock, and the heating time in pipe or tube making, thereby preventing internal surface defects.

The Patent Document 6 discloses a method for manufacturing a martensitic stainless seamless steel pipe or tube, capable of improving the microstructure in hot working by regulating the contents of specified alloy components and adjusting the cross angle and the feed angle at the time of piercing and rolling, thereby preventing internal surface defects.

Patent Document 1: Japanese Laid-Open Patent Publication No. 59-208055,

Patent Document 2: Japanese Laid-Open Patent Publication No. 63-281705,

Patent Document 3: Japanese Laid-Open Patent Publication No. 4-224659,

Patent Document 4: Japanese Laid-Open Patent Publication No. 5-69011,

Patent Document 5: Japanese Laid-Open Patent Publication No. 2003-3212,

Patent Document 6: Japanese Laid-Open Patent Publication No. 2004-43935.

DISCLOSURE OF THE INVENTION

Problems to be Solved by the Invention

Even if the techniques proposed by the Patent Documents 1 to 6 described above are applied, the internal surface defects in the piercing and rolling stage would not necessarily be suppressed in high-Cr seamless steel pipes or tubes containing 10.50 to 14.0% of Cr.

That is to say, the technique proposed by the Patent Document 1 does not regulate the condition of the piercing and rolling by a piercing mill. Therefore, the internal fracture flaws would not necessarily be suppressed even if a steel stock with low contents of P and S is used.

Although the technique proposed by the Patent Document 2 regulates the condition of the piercing and rolling by a piercing mill, the purpose is only to suppress occurrence of δ-ferrite by reducing an average strain rate. Therefore, like the technique of the above-mentioned Patent Document 1, it would not necessarily suppress internal fracture flaws.

The technique proposed by the Patent Document 3 does not regulate the condition of the piercing and rolling by a piercing mill as it is described that "a general means can be used in the rolling process of a seamless steel pipe or tube. Therefore, the occurrence of internal fracture flaws is often unavoidable".

Since the technique proposed by the Patent Document 4 only regulates the above-mentioned content as the condition of the piercing and rolling by a piercing mill, the internal fracture flaws would not necessarily be suppressed.

The technique proposed by the Patent Document 5, also, describes that "the rolling process of a seamless steel pipe or tube can be a general manufacturing process of a seamless steel pipe or tube" similar to the above-mentioned Patent Document 3, and does not regulate the condition of the piercing and rolling by a piercing mill. Therefore, the internal fracture flaws are often unavoidable.

Since the technique proposed by the Patent Document 6 simply regulates the cross angle and the feed angle as the condition of the piercing and rolling by a piercing mill, the internal fracture flaws would not necessarily be suppressed.

For solving the problem as described above, the present inventors observed actual internal fracture flaws on the high-Cr steel pipes or tubes in detail in order to examine the causal relationship between occurring the flaws and the conditions, such as the round billet heating condition or various conditions of the piercing and rolling.

This resulted in finding that all the internal fracture flaws on steel pipes or tubes could not be necessarily distinguished clearly between the material-originated ones and the machine-originated ones. That is to say, it was found that the internal fracture flaws on steel pipes or tubes have strong correlation with not only material-originated flaws but also "piercing efficiency" that is one of factors related to Mannesmann effect of a piercing mill.

From the viewpoint of the above-mentioned content, it is an objective of the present application technology to provide a method for manufacturing a high-Cr seamless steel pipe or tube, particularly a high-Cr seamless steel pipe or tube containing, by mass %, 10.50 to 14.00% of Cr, capable of suppressing, internal fracture flaws among the internal surface defects caused at the time of piercing and rolling by a piercing mill.

Means for Solving the Problem

The gist of the present application technology is a method for manufacturing a high-Cr seamless steel pipe or tube described in the following (1) to (3).

(1) A method for manufacturing a high-Cr seamless steel pipe or tube, comprised by heating a round billet in a heating furnace followed by piercing and rolling with an inclined roll type piercing mill, the said round billet containing, by mass %, 10.50 to 14.00% of Cr, with a value of Cr* represented by the following equation (1) of not more than 9.0%;

the said heating furnace being set so that an in-furnace time from the charging of the round billet into the heating furnace to the discharging therefrom satisfies the following equation (2) at a soaking temperature of 1100 to 1250° C.; and the said inclined roll type piercing mill having a piercing efficiency of not less than 50% and a plug tip draft rate represented by the following equation (3) of not more than 8.0% as the piercing and rolling conditions thereby:

$$Cr^*=Cr+4Si-(22C+0.5Mn+1.5Ni+30N) \quad (1),$$

$$\text{In-furnace time (min)} \geqq 0.5\times\text{Diameter of the round billet (mm)} \quad (2),$$

$$\text{Plug tip draft rate (\%)}=\{(\text{Diameter of the round billet (mm)}-\text{Roll gap at the foremost end of the plug (mm)})/\text{Diameter of the round billet (mm)}\}\times 100 \quad (3),$$

wherein, in the above equation (1), the symbols of the elements represent the contents, by mass %, of the elements in the high-Cr steel.

(2) A method for manufacturing a high-Cr seamless steel pipe or tube, comprised by heating a round billet in a heating furnace followed by piercing and rolling with an inclined roll type piercing mill, the said round billet containing, by mass %, 10.50 to 14.00% of Cr, with a value of Cr* represented by the following equation (1) of not more than 9.0%;

the said heating furnace being set so that an in-furnace time from the charging of the round billet into the heating furnace to the discharging therefrom satisfies the following equation (2) at a soaking temperature of 1100 to 1250° C.; and the said inclined roll type piercing mill having a roll surface roughness $Rz_{JIS}$ of 50 to 200 μm and a plug tip draft rate represented by the following equation (3) of not more than 8.0%:

$$Cr^*=Cr+4Si-(22C+0.5Mn+1.5Ni+30N) \quad (1),$$

$$\text{In-furnace time (min)} \geqq 0.5\times\text{Diameter of the round billet (mm)} \quad (2),$$

$$\text{Plug tip draft rate (\%)}=\{(\text{Diameter of the round billet (mm)}-\text{Roll gap at the foremost end of the plug (mm)})/\text{Diameter of the round billet (mm)}\}\times 100 \quad (3),$$

wherein, in the above equation (1), the symbols of the elements represent the contents, by mass %, of the elements in the high-Cr steel.

(3) The method for manufacturing a high-Cr seamless steel pipe or tube according to (1) or (2) above, wherein a plug shape value represented by the following equation (4) of a plug to be used in the piercing and rolling stage is 0.06 to 0.17:

$$\text{Plug shape value}=\text{Radius of foremost end of the plug (mm)}/\text{Diameter of the round billet (mm)} \quad (4).$$

The "$Rz_{JIS}$" for the roll surface roughness means the "ten-point average roughness" in JIS B 0601 (2001) in the direction of right angles to the roll axis.

The above-mentioned (1) to (3), related to the method for manufacturing a high-Cr seamless steel pipe or tube are referred to as "the present technology (1)" to "the present technology (3)", or collectively referred to as "the present technology".

Effect of the Invention

According to the method of the present technology, in manufacturing the high-Cr seamless steel pipes or tubes, the internal fracture flaws among the internal surface defects, which are caused at the time of piercing and rolling by a piercing mill, can be suppressed.

Best Mode for Carrying Out the Invention

In order to solve the above-mentioned problem, the present technologists made various investigations into the occurrence state of internal fracture flaws that are one of internal surface defects caused at the time of piercing and rolling by a piercing mill.

As a result, it was found that the internal fracture flaws can be remarkably suppressed by preventing the occurrence of δ-ferrite and adjusting the condition of piercing and rolling by a piercing mill, particularly, by adjusting chemical composition and billet soaking condition for preventing the occurrence of δ-ferrite and by the reducing roll forging frequency as the condition of piercing and rolling by a piercing mill, as shown in the following (a) to (d).

(a) The occurrence of δ-ferrite is minimized by setting the chemical composition of the billet so as to contain 10.50 to 14.00% of Cr and have a value of Cr* represented by the equation (1) of not more than 9.0%, whereby the internal fracture flaws which occur in the piercing and rolling by a piercing mill can be suppressed.

(b) Prior to the piercing and rolling by a piercing mill, the billet of the above-mentioned chemical composition is heated in a heating furnace at a soaking temperature of 1100 to 1250° C. so that the in-furnace time satisfies the equation (2), whereby the occurrence of δ-ferrite can be suppressed by the soaking effect. Therefore, the internal fracture flaws which occur in the piercing and rolling by a piercing mill can be suppressed.

(c) The internal fracture flaws which occur in the piercing and rolling by a piercing mill can be suppressed by reducing the roll forging frequency N represented by the following equation (5).

$$N=(2L\times Brps)/\{(\text{Circumferential speed at the roll gouge position}\times\sin\beta\times\text{Piercing efficiency})/\text{Piercing ratio}\} \quad (5);$$

wherein, in the above equation (5), the meanings of L, Brps and Piercing ratio are as follows:

L: Distance from the billet biting position to the tip of the plug,

Brps: Rotating speed of the billet, that is to say, "Roll circumferential speed at the billet biting position/Circumferential length of the billet", and, Piercing ratio: "Length of the hollow pipe or tube stock/Length of the billet".

In the above equation, "β" represents the feed angle (°) of the roll, and "piercing efficiency" means the rolling-directional advance efficiency (%) of the piercing mill.

(d) The reduction in the roll forging frequency of the billet can be attained by reducing the value of "L" or increasing the value of the piercing efficiency in the above-mentioned equation. For the reduction of the value of "L", the "plug tip draft rate" is preferably reduced to not more than 8.0%, while the "piercing efficiency" is preferably set to not less than 50%. Although it was considered to increase the feed angle of the roll "β", this could cause defective biting of a billet to rolls.

Therefore, the condition for improving the "piercing efficiency" in the piercing and rolling by a piercing mill was further examined in detail. Consequently, the following findings (e) and (f) were obtained.

(e) Piercing and rolling using rolls with a surface roughness $Rz_{JIS}$ of 50 to 200 μm leads to further improvement in the "piercing efficiency". As described above, the "$Rz_{JIS}$" for the roll surface roughness means the "ten-point average roughness" in JIS B 0601 (2001) in the direction of right angles to the roll axis.

(f) Piercing and rolling using a pointed plug, which has a plug shape value represented by the above-mentioned equation (4) of 0.06 to 0.17, also leads to improvement in the "piercing efficiency".

The present technology (1) to (3) have been accomplished on the basis of the above-mentioned findings.

All of the requirement of the present technology will next be described in detail. In the following description, the symbol "%" of the content of each element represent "% by mass".

(A) Chemical Composition of a Steel

A round billet, that is a steel stock for a high-Cr seamless steel pipe or tube, according to the present technology needs to be made of high-Cr steel which has a chemical composition containing 10.50 to 14.00% of Cr, with a value of Cr* represented by the above-mentioned equation (1) of not more than 9.0%.

Cr: 10.50 to 14.00%

Cr is an essential component element for improving corrosion resistance. When the content of Cr is less than 10.50%, the desired resistance to pitting and crevice corrosion, and corrosion resistance in a carbon dioxide environment cannot be ensured. On the other hand, if the content of Cr exceeds 14.00%, δ-ferrite is easily occurred at the time of high-temperature working since Cr is a ferrite forming element, and the hot workability is impaired. Moreover, an excessive addition of Cr leads to an increase in manufacturing cost. Therefore, the content of Cr is set to 10.50 to 14.00%. The more preferable range of Cr content is from 11.00 to 13.10%.

Cr* value: not more than 9.0%

When the value of Cr* represented by the above-mentioned equation (1) exceeds 9.0%, δ-ferrite is easily occurred even if the content of Cr is within the above range of 10.50 to 14.00%, and so, the sulfide stress cracking resistance and hot workability are deteriorated. Therefore, the value of Cr* represented by the above-mentioned equation (1) is set to not more than 9.0%.

From the above-mentioned reason, a high-Cr steel which has a chemical composition containing 10.50 to 14.00% of Cr and having a value of Cr* represented by the above-mentioned equation (1) of not more than 9.0% is used as the round billet, that is the steel stock to be pierced and rolled by a piercing mill in the present technology.

Only the regulation of Cr content and the value of Cr* represented by the above-mentioned equation (1) as the chemical composition suffices for the round billet that is the steel stock for a high-Cr seamless steel pipe or tube of the present technology.

As a preferable chemical composition, for example, a high-Cr steel which contains C: 0.15 to 0.22%, Si: 0.1 to 1.0%, Mn: 0.10 to 1.00%, Cr: 12.00 to 14.00%, P: not more than 0.020%, S: not more than 0.010%, N: not more than 0.05%, O (oxygen): not more than 0.0060%, one or more elements selected from 0.005 to 0.200% each of V, Nb and Ti and 0.0005 to 0.0100% of B (a total of 0.005 to 0.200% in combination of two or more thereof), Al: 0 to 0.1%, Ni: 0 to 0.5%, Cu: 0 to 0.25%, Ca: 0 to 0.0050% and the balance being Fe and impurities, with a value of Cr* represented by the equation (1) of not more than 9% can be recommended.

As another preferable chemical composition, for example, a high-Cr steel which contains C: 0.003 to 0.050%, Si: 0.05 to 1.0%, Mn: 0.10 to 1.50%, Cr: 10.50 to 14.00%, P: not more than 0.035%, S: not more than 0.010%, N: not more than 0.070%, O (oxygen): not more than 0.0060%, V: 0 to 0.200%, Ti: 0 to 0.300%, Mo: 0.2 to 3.0%, Ni: 0 to 7.0%, Zr: 0 to 0.580% and the balance being Fe and impurities, with a value of Cr* represented by the equation (1) of not more than 9% can also be recommended.

(B) Heating Condition of a Round Billet

In the present technology, it is necessary to heat the round billet, that is the steel stock for a high-Cr seamless steel pipe or tube, which has the above-mentioned chemical composition in a heating furnace at a soaking temperature 1100 to 1250° C. so that the in-furnace time satisfies the above-mentioned equation (2).

When a soaking temperature is below 1100° C., the rolling temperature in the piercing and rolling stage by a piercing mill, or the rolling temperature in elongation by a mandrel mill or a plug mill is reduced. Therefore, in that case, the deformation resistance of the steel stock to be rolled increases, and the rolling becomes unstable and seizure flaws are easily caused.

When a soaking temperature is over 1250° C., δ-ferrite is occurred and grown, and then, the internal fracture flaws are also easily caused.

If the in-furnace time of the round billet in the heating furnace does not satisfy the above-mentioned equation (2) even at a soaking temperature of 1100 to 1250° C., the round billet center part cannot be sufficiently soaked and this make it difficult to stably pierce and roll the billet by the piercing mill. Consequently, the as-set rolling by the piercing mill is difficult to realize, causing a deterioration of the even wall thickness rate or the like.

Therefore, in the present technology, the round billet, that is the steel stock to be pierced and rolled by the piercing mill, is heated at a soaking temperature of 1100 to 1250° C. so that the in-furnace time from charging of the round billet into the heating furnace to the discharging therefrom satisfies the above-mentioned equation (2).

In order to prevent the reduction in rolling yield by scale loss, the above-mentioned in-furnace time in the heating furnace is desirably set to less than "1.5×diameter of the round billet (mm)".

(C) Piercing and Rolling by a Piercing Mill

In the present technology, the round billet, that is the steel stock for a high-Cr seamless steel pipe or tube, having the chemical composition described in the above-mentioned (A), must be pierced and rolled with a plug tip draft rate of not more than 8.0% in a process after heating in the condition described in the above-mentioned (B).

A plug tip draft rate exceeding 8.0% means that the value of "L" in the above-mentioned equation (5), that is to say, the distance from the billet biting position to the tip of the plug is geometrically large. Since the roll forging frequency N, represented by the above-mentioned equation (5), is increased in this case, so-called "Mannesmann fractures" are excessively caused, which leads to an easy occurrence of internal fracture flaws. The lower limit of the plug tip draft rate is about 3.0% at which the billet can be geometrically bitten into the rolls of piercing mill.

When the piercing efficiency in a piercing mill is below 50%, the roll forging frequency N represented by the above-mentioned equation (5) is increased, the said so-called "Mannesmann fractures" are excessively caused, which facilitates the occurrence of the internal fracture flaws. The upper limit of the piercing efficiency by a piercing mill is empirically about 60 to 70% in barrel type rolls with a cross angle of 0°, or about 80 to 90% in cone type rolls with a cross angle of 5 to 30°.

Consequently, in the present technology (1), the round billet, that is the steel stock for a high-Cr seamless steel pipe or tube, having the chemical composition described in the above (A), is pierced and rolled with a piercing efficiency by a piercing mill of not less than 50% and a plug tip draft rate of not more than 8.0% in a process after heating in the condition described in the above (B). The upper limit of the plug tip draft rate is desirably set to about 6.0%.

When the piercing and rolling is performed, using rolls with a surface roughness $Rz_{JIS}$ of not less than 50 μm, an appropriate frictional force is produced between the rolling material, extending from the billet under piercing and rolling to a hollow pipe or tube stock and the roll, and the piercing efficiency can be enhanced. However, when the surface roughness $Rz_{JIS}$ exceeds 200 μm, the external surface property in the final product may be deteriorated by transfer of the surface state of the rolls to the external surface of the hollow pipe or tube stock.

Accordingly, the piercing and rolling is preferably carried out using a piercing mill with a roll surface roughness $Rz_{JIS}$ of 50 to 200 μm.

In the present technology (2), therefore, the round billet, that is the steel stock for a high-Cr seamless steel pipe or tube, having the chemical composition described in the above (A), is pierced and rolled, in a process after heating in the condition described in the above (B), using a piercing mill which has a roll surface roughness $Rz_{JIS}$ of 50 to 200 μm, with a plug tip draft rate being set to not more than 8.0%.

The upper limit of the plug tip draft rate is desirably about 6.0% as described above.

The roll with a surface roughness $Rz_{JIS}$ of 50 to 200 μm can be obtained, for example, by performing surface treatment to a roll in the general method, or by rolling the so-called "common steel" in order to rough the surface. As mentioned above, the "$Rz_{JIS}$" for the roll surface roughness means the "ten-point average roughness" in JIS B 0601 (2001) in the direction of right angles to the roll axis.

When the piercing and rolling is carried out using a pointed plug with a plug shape value of 0.06 to 0.17, represented by the above-mentioned equation (4), the "piercing efficiency" is also improved, and the occurrence of internal fracture flaws can thus be further effectively suppressed. If the plug shape value is smaller than 0.06, the acute plug shape can be eroded by heat. On the other hand, a plug shape value larger than 0.17 can cause defective biting.

Consequently, in the present technology (3), the plug shape value represented by the above-mentioned equation (4) of the plug to be used in the piercing and rolling stage is set to 0.06 to 0.17.

The present technology will be further described in more detail. The present technology is never limited by the following examples and can be executed with proper modifications within the range adaptable to the effects described above and later. These should be included in the technical scope of the present technology.

PREFERRED EMBODIMENT

Example 1

The ingots which have chemical compositions shown in Table 1 were hot rolled in a blooming mill by a general method and made into round billets of 225 mm in diameter. The steels A1 and B1 in Table 1 are the steels related to the examples with chemical compositions within the range regulated by the present technology. On the other hand, the steels A2 and B2 are the steels with Cr* and a Cr content out of the range regulated by the present technology, respectively.

TABLE 1

| | Chemical composition (% by mass) Balance: Fe and impurities | | | | | | | | | | | |
|---|---|---|---|---|---|---|---|---|---|---|---|---|
| Steel | C | Si | Mn | P | S | Cr | Cu | Ni | Mo | Ti | N | Cr* |
| A1 | 0.19 | 0.27 | 0.85 | 0.014 | 0.003 | 12.8 | 0.04 | 0.08 | — | — | 0.035 | 8.105 |
| A2 | 0.17 | 0.28 | 0.44 | 0.012 | 0.003 | 13.2 | 0.06 | 0.11 | — | — | 0.020 | # 9.595 |
| B1 | 0.008 | 0.24 | 0.77 | 0.015 | 0.003 | 12.6 | 0.25 | 5.90 | 2.0 | 0.08 | 0.005 | 3.999 |
| B2 | 0.007 | 0.24 | 0.78 | 0.014 | 0.003 | #14.3 | 0.30 | 5.80 | 2.0 | 0.08 | 0.005 | 5.866 |

Cr* = Cr + 4Si − (22C + 0.5Mn + 1.5Ni + 30N)
The mark # indicates falling outside the condition specified by the present technology.

The round billet of the above-mentioned size of each steel was charge into a heating furnace, heated in a condition shown in Table 2, and pierced and rolled with a piercing mill by a general method with piercing efficiency and plug tip draft rate of 52% and 7.7%, respectively, in order to produce a pipe stock with an outer diameter of 230 mm and a wall thickness of 20 mm. As for the in-furnace time represented by the above-mentioned equation (2), "0.5×225 (mm)" minutes or more, that is to say, 112.5 minutes or more is needed.

TABLE 2

| Heating Condition No. | Soaking Temperature (° C.) | In-furnace Time of Billet (min) |
|---|---|---|
| 1 | 1115 | 120 |
| 2 | 1115 | 300 |
| 3 | 1240 | 120 |
| 4 | 1240 | 300 |
| 5 | # 1265 | 120 |
| 6 | # 1265 | 300 |

The mark # indicates falling outside the condition specified by the present technology.

Each of the thus-obtained pipe stocks was inspected for internal surface defects by an ultrasonic flaw detecting test method and visual confirmation. That is to say, the occurrence positions of internal surface defects were specified and marked by an ultrasonic flaw detecting test, and these portions were cut off and evaluated by a visual inspection. Further, an investigation for defective rolling such as the uneven wall thickness was carried out by a visual inspection and an ultrasonic flaw detecting test.

The result of each investigated property of the pipe stocks is shown in Table 3. In Table 3, the marks "○" and "x" show that the occurrence rates of internal fracture flaw on pipe stock internal surface are less than 10% and not less than 10%, respectively. As for the occurrence rate of the internal fracture flaw, the ratio of the number of steel pipes with occurrence of internal fracture flaws to the total number of all steel pipes inspected was evaluated.

TABLE 3

| Heating Condition | Properties of the pipe stocks | | | |
|---|---|---|---|---|
| No. | Steel A1 | Steel B2 | # Steel A2 | # Steel B2 |
| 1 | ○ | ○ | X | X |
| 2 | ○ | ○ | X | X |
| 3 | ○ | ○ | X | X |
| 4 | ○ | ○ | X | X |

TABLE 3-continued

| Heating Condition | Properties of the pipe stocks | | | |
|---|---|---|---|---|
| No. | Steel A1 | Steel B2 | # Steel A2 | # Steel B2 |
| 5 | X | X | X | X |
| 6 | X | X | X | X |

The marks "○" and "X" show that internal fracture flaw occurrence rate in pipe stock internal surface are less than 10% and not less than 10%, respectively.
The mark # indicates falling outside the condition specified by the present technology.

It is apparent from Table 3 that the pipe stocks obtained by heating the round billets of the steels A1 and B1, which have the chemical compositions regulated by the present technology in the heating condition Nos. 1 and 4, regulated by the present technology, and performing piercing and rolling by a piercing mill with piercing efficiency of 52% and plug tip draft rate of 7.7% have satisfactory internal surface properties. No defective rolling such as the uneven wall thickness was observed in any of these pipe stocks. In the cases of heating condition Nos. 1 to 4, each in-furnace time is less than 337.5 minutes, and so, scale loss which causes a reduction in yield does not take place.

On the other hand, in the cases using the round billets of the steels A2 and B2, out of the chemical composition range regulated by the present technology, a large number of internal fracture flaws were caused in the resulting pipe stocks even if the heating condition and the piercing condition by the piercing mill are within the ranges regulated by the present technology.

Example 2

The round billet having a 225 mm diameter of the steel A1 produced in Example 1 was heated at a soaking temperature of 1200° C. so that the in-furnace time was 180 minutes, and pierced and rolled by a piercing mill with piercing efficiencies and plug tip draft rates which are shown in Table 4, in order to produce pipe stocks with an outer diameter of 230 mm and a wall thickness of 20 mm. In the piercing condition Nos. 4, 8 and 12 in Table 4 with a plug tip draft rate of 2.8%, the piercing and rolling could not be carried out due to defective biting.

TABLE 4

| Piercing Condition No. | Piercing Efficiency (%) | Plug Tip Draft Rate (%) | Properties of the Pipe Stocks |
|---|---|---|---|
| 1 | 45 | 8.2 | X |
| 2 | 45 | 7.7 | X |
| 3 | 45 | 5.8 | X |
| 4 | 45 | 2.8 | — |
| 5 | 52 | 8.2 | X |
| 6 | 52 | 7.7 | ○ |
| 7 | 52 | 5.8 | ○ |
| 8 | 52 | 2.8 | — |
| 9 | 75 | 8.2 | X |
| 10 | 75 | 7.7 | ○ |
| 11 | 75 | 5.8 | ○ |
| 12 | 75 | 2.8 | — |

In the column of "Properties of the Pipe Stocks" the marks "○" and "X" show that the occurrence rates of internal fracture flaw on pipe stock internal surface are less than 10% and not less than 10%, respectively.
The mark "—" indicates that no investigation was performed because piercing rolling could not be carried out due to defective biting.

Each of the thus-obtained pipe stocks in the piercing condition Nos. 1 to 3, 5 to 7 to 9 to 11 in Table 4 was inspected for internal fracture flaw. That is to say, similarly to in Example 1, the occurrence positions of internal surface defects were specified and marked by an ultrasonic flaw detecting test, and these portions were cut off and evaluated by a visual inspection. Further, an investigation for defective rolling such as the uneven wall thickness was carried out by a visual inspection and an ultrasonic flaw detecting test.

In result of each investigated property of the pipe stocks is also shown in Table 4. In Table 4, the marks "○" and "x" show that the occurrence rates of internal fracture flaw on pipe stock internal surface are less than 10% and not less than 10%, respectively. The mark "-" shows that no investigation was performed because the piercing and rolling could not be carried out due to defective biting.

It is apparent from Table 4 that the pipe stocks obtained by heating the round billet of the steel A1, which has a chemical composition regulated by the present technology, in the heating condition regulated by the present technology, and performing piercing and rolling in conditions regulated by the present technology (that is, in the piercing condition Nos. 6, 7, 10 and 11) have satisfactory internal surface properties. No defective rolling such as the uneven wall thickness was observed in any of these pipe stocks.

On the other hand, a large number of internal fracture flaws were caused in the pipe stocks in the piercing condition Nos. 1 to 3, 5, and 9, with piercing conditions out of the range regulated by the present technology, even if the round billet of the steel A1, which has a chemical composition regulated by the present technology, is heated in the heating condition regulated by the present technology. As mentioned above, in the piercing conditions Nos. 4, 8 and 12 with a plug tip draft rate of 2.8%, the piercing and rolling itself could not be carried out due to defective biting.

Example 3

The round billet having a 225 mm diameter of the steel A1 produced in Example 1 was heated at a soaking temperature of 1200° C. so that the in-furnace time was 150 minutes, and pierced and rolled, while changing the surface roughness $Rz_{JIS}$ of the rolls of the piercing mill from 45 to 210 μm, in order to produce pipe stocks with an outer diameter of 230 mm and a wall thickness of 20 mm. In each the roll roughness condition No. in Table 5, the plug tip draft rate in the piercing and rolling by the piercing mill was set to 5.6%.

TABLE 5

| Roll Surface Roughness Condition No. | Roll Surface Roughness [RzJIS] (μm) | Plug Tip Draft Rate (%) | Piercing Efficiency (%) | Plug Shape Value | Occurrence State of Internal Fracture Flaw | Notes |
|---|---|---|---|---|---|---|
| 1 | 45 | 5.6 | 54 | 0.05 | ○ | Erosion of plug tip and slippage were often caused. |
| | | | 53 | 0.06 | | Slippage was often caused. |
| | | | 52 | 0.10 | | Slippage was often caused. |
| | | | 51 | 0.17 | | Slippage was often caused. |
| | | | 50 | 0.18 | | Defective biting and slippage were often caused. |
| 2 | 55 | | 58 | 0.05 | ○○ | Slippage was often caused. |
| | | | 57 | 0.06 | | |
| | | | 56 | 0.10 | | |
| | | | 55 | 0.17 | | |
| | | | 54 | 0.18 | ○ | Defective biting was often caused. |
| 3 | 100 | | 68 | 0.05 | ○○ | Erosion of plug tip was often caused. |
| | | | 67 | 0.06 | | |
| | | | 66 | 0.10 | | |
| | | | 65 | 0.17 | | |
| | | | 64 | 0.18 | | Defective biting was often caused. |
| 4 | 130 | | 73 | 0.05 | ¤ | Erosion of plug tip was often caused. |
| | | | 72 | 0.06 | | |
| | | | 71 | 0.10 | | |
| | | | 70 | 0.17 | | |
| | | | 69 | 0.18 | ○○ | Defective biting was often caused. |
| 5 | 195 | | 79 | 0.05 | ¤ | Erosion of plug tip was often caused. |
| | | | 78 | 0.06 | | |
| | | | 77 | 0.10 | | |
| | | | 76 | 0.17 | | |
| | | | 75 | 0.18 | | Defective biting was often caused. |

TABLE 5-continued

| Roll Surface Roughness Condition No. | Roll Surface Roughness [RzJIS] (μm) | Plug Tip Draft Rate (%) | Piercing Efficiency (%) | Plug Shape Value | Occurrence State of Internal Fracture Flaw | Notes |
|---|---|---|---|---|---|---|
| 6 | 210 | | 80 | 0.05 | ¤ | External surface flaw occurred. Erosion of plug tip was often caused. |
| | | | 79 | 0.06 | | External surface flaw occurred. |
| | | | 78 | 0.10 | | External surface flaw occurred. |
| | | | 77 | 0.17 | | External surface flaw occurred. |
| | | | 76 | 0.18 | | External surface flaw occurred. Defective biting was often caused. |

In the column of "Occurrence State of Internal Fracture Flaw", the marks "¤", "○○" and "○" show that the occurrence rates of internal fracture flaw on pipe stock internal surface are less than 3%, not less than 3% to less than 5%, and not less than 5% to less than 10%, respectively.

Each of the obtained pipe stocks was investigated for internal surface properties. That is to say, similarly to in Example 1, the occurrence positions of internal surface defects were specified and marked by an ultrasonic flaw detecting test, and these portions were cut and evaluated by a visual inspection. Further, investigations for the external surface flaws and for the state of defective rolling such as the uneven wall thickness were carried out by an ultrasonic flaw detecting test and a visual inspection.

The result of each internal surface property inspection of the pipe stock is also shown in Table 5. In Table 5, the marks "¤", "○○", and "○" show that the occurrence rates of internal fracture flaw on pipe stock internal surface are less than 3%, not less than 3% to less than 5%, and not less than 5% to less than 10%, respectively.

It is apparent from Table 5 that the pipe stocks obtained by heating the round billet of the steel A1, which has a chemical composition regulated by the present technology, in the heating condition regulated by the present technology, and performing piercing and rolling using a piercing mill with a roll surface roughness $Rz_{JIS}$ of 50 to 200 μm, have further satisfactory internal surface properties.

The state of defective rolling such as the uneven wall thickness was not observed in any of the pipe stocks. However, in the roll surface roughness condition No. 1, the state of defective rolling by slippage was often caused. Also the roll surface roughness condition No. 6, external surface flaws by the transfer of the roll surface state to the steel external surface were observed.

When the plug shape value in Table 5 is 0.05, erosion of plug was often caused, since the volume of the plug tip part was minimized, and the thermal capacity was also minimized. When the plug shape value is 0.18, defective biting was often caused because the tip part shape gets too close to obtuse angle.

As is apparent from Table 5, according to the method of the present technology (3), namely by using a plug with a plug shape value of 0.06 to 0.17 at the time of piercing and rolling in the condition regulated by the present technology (1), after heating the round billet of the steel A1, which has a chemical composition regulated by the present technology in the heating condition regulated by the present technology, the internal surface properties of the resulting pipe stock can be further enhanced. According to the method of the present technology (3), namely by using a plug having a shape value of 0.06 to 0.17 at the time of piercing and rolling in the condition regulated by the present technology (2), the internal surface properties of the resulting pipe stock can also be further enhanced. In each case, the state of defective rolling such as the uneven wall thickness was not observed.

INDUSTRIAL APPLICABILITY

According to the manufacturing method of the present technology, a high-Cr seamless steel pipe or tube with minimized internal surface defects can be manufactured. Further, since it is not necessary to excessively reduce the impurities in the chemical composition of the steel, and predetermined productivity can be ensured in pipe or tube making, a high-Cr seamless steel pipe or tube, excellent in internal surface properties, can be efficiently manufactured.

What is claimed is:

1. A method for manufacturing a high-Cr seamless steel pipe or tube, comprised by heating a round billet in a heating furnace followed by piercing and rolling with an inclined roll type piercing mill, the said round billet containing, by mass %, 10.50 to 14.00% of Cr, with a value of Cr* represented by the following equation (1) of not more than 9.0%;

the said heating furnace being set so that an in-furnace time from the charging of the round billet into the heating furnace to the discharging therefrom satisfies the following equation (2) at a soaking temperature of 1100 to 1250° C.; and the said inclined roll type piercing mill having a piercing efficiency of not less than 50% and a plug tip draft rate represented by the following equation (3) of not more than 8.0% as the piercing and rolling conditions thereby:

$$Cr^*=Cr+4Si-(22C+0.5Mn+1.5Ni+30N) \quad (1),$$

$$\text{In-furnace time (min)} \geqq 0.5\times\text{Diameter of the round billet (mm)} \quad (2),$$

$$\text{Plug tip draft rate (\%)}=\{(\text{Diameter of the round billet (mm)}-\text{Roll gap at the foremost end of the plug (mm)})/\text{Diameter of the round billet (mm)}\}\times 100 \quad (3),$$

wherein, in the above equation (1), the symbols of the elements represent the contents, by mass %, of the elements in the high-Cr steel.

2. A method for manufacturing a high-Cr seamless steel pipe or tube, comprised by heating a round billet in a heating furnace followed by piercing and rolling with an inclined roll type piercing mill, the said round billet containing, by mass %, 10.50 to 14.00% of Cr, with a value of Cr* represented by the following equation (1) of not more than 9.0%;

the said heating furnace being set so that an in-furnace time from the charging of the round billet into the heating furnace to the discharging therefrom satisfies the following equation (2) at a soaking temperature of 1100 to 1250° C.; and the said inclined roll type piercing mill having a roll surface roughness $Rz_{JIS}$ of 50 to 200 μm and a plug tip draft rate represented by the following equation (3) of not more than 8.0%:

$$Cr^*=Cr+4Si-(22C+0.5Mn+1.5Ni+30N) \quad (1),$$

$$\text{In-furnace time (min)} \geqq 0.5\times\text{Diameter of the round billet (mm)} \quad (2),$$

$$\text{Plug tip draft rate (\%)}=\{(\text{Diameter of the round billet (mm)}-\text{Roll gap at the foremost end of the plug (mm)})/\text{Diameter of the round billet (mm)}\}\times 100 \quad (3),$$

wherein, in the above equation (1), the symbols of the elements represent the contents, by mass %, of the elements in the high-Cr steel.

3. The method for manufacturing a high-Cr seamless steel pipe or tube according to claim 1, wherein a plug shape value represented by the following equation (4) of a plug to be used in the piercing and rolling stage is 0.06 to 0.17;

$$\text{Plug shape value}=\text{Radius of foremost end of the plug (mm)}/\text{Diameter of the round billet (mm)} \quad (4).$$

4. The method for manufacturing a high-Cr seamless steel pipe or tube according to claim 2, wherein a plug shape value represented by the following equation (4) of a plug to be used in the piercing and rolling stage is 0.06 to 0.17;

$$\text{Plug shape value}=\text{Radius of foremost end of the plug (mm)}/\text{Diameter of the round billet (mm)} \quad (4).$$

* * * * *